United States Patent [19]

Farrall

[11] Patent Number: 4,534,741

[45] Date of Patent: Aug. 13, 1985

[54] METHOD FOR ASSESSING THE DIELECTRIC STATE OF A HIGH VOLTAGE VACUUM DEVICE USING RADIATION GENERATED BY FIELD EMISSION CURRENT

[75] Inventor: George A. Farrall, Rexford, N.Y.

[73] Assignee: General Electric Company, Schenectady, N.Y.

[21] Appl. No.: 568,318

[22] Filed: Jan. 5, 1984

[51] Int. Cl.[3] ..... H01J 9/50

[52] U.S. Cl. ..... 445/3; 445/6; 324/409

[58] Field of Search ..... 445/3, 6, 18, 20, 50, 445/51, 63; 324/409, 410; 378/207

[56] References Cited

U.S. PATENT DOCUMENTS 3,915,533 10/1975 Kozicki ..... 324/409

OTHER PUBLICATIONS

J. M. Lafferty, Editor, Vacuum Arcs–Theory & Application, pp. 24–35, John Wiley and Sons, NY, (1980).

*Primary Examiner*—Kenneth J. Ramsey
*Assistant Examiner*—Kurt Rowan
*Attorney, Agent, or Firm*—Marvin Snyder; James C. Davis, Jr.

[57] ABSTRACT

The radiation generated by electrons from field emission current striking the anode of a high voltage vacuum device is used as an analog for the emission current in a method for assessing the dielectric state of the device. The emission current is determined by applying a variable voltage, less than that required to produce breakdown, to the device and measuring the radiation generated by the emission current. The radiation measurement is correlated to the amount of field emission current by means of a predetermined relationship, and the field enhancement factor, $\beta$, associated with the dielectric state of the device is determined from the slope of a plot of the logarithm of the quantity resulting from dividing the emission current by the square of the applied voltage, versus the reciprocal of the applied voltage. Alternatively, $\beta$ may be determined from the slope of a plot of the measured radiation versus the reciprocal voltage. A method for conditioning high voltage vacuum devices to improve the dielectric properties thereof employs one of the above methods for determining $\beta$ and further includes subjecting the device to a predetermined program of voltage exposure until $\beta$ is below a predetermined value.

11 Claims, 2 Drawing Figures

METHOD FOR ASSESSING THE DIELECTRIC STATE OF A HIGH VOLTAGE VACUUM DEVICE USING RADIATION GENERATED BY FIELD EMISSION CURRENT

BACKGROUND OF THE INVENTION

This invention relates to assessing the dielectric capability of a vacuum device, and to conditioning such devices to improve the dielectric properties thereof. More particularly, it relates to using the radiation generated by field emission current as a means for determining the amount of that current, and to using the radiation to determine the field enhancement factor associated with the dielectric state of the gap between the cathode and the anode of the vacuum device.

It is often desirable to know the dielectric strength of the gap between the cathode and the anode in a vacuum device. Perhaps the simplest way of testing the dielectric strength of such a gap is to apply sufficient voltage between the cathode and the anode to cause breakdown. However, this simple procedure is not a reliable determination of the dielectric strength, because breakdown voltage in a given trial is highly variable and many trials are required to obtain a reasonably accurate measurement of the true dielectric strength. Moreover, this procedure, in and of itself, may cause physical damage to the electrode surfaces, and thereby alter the results obtained for subsequent measurements of the breakdown voltage. A theoretically more accurate method of determining the dielectric strength is to measure the field emission current between the cathode and the anode as a function of applied voltage, where the voltage approaches, but does not exceed, the expected breakdown voltage of the gap. The dependence of emission current upon the voltage between electrodes is well known and described by field emission theory. Furthermore, this emission current can be related to the dielectric strength of the gap, as described hereinbelow.

In many circumstances, breakdown in a vacuum gap has been found to occur at a relatively constant electric field strength. This field, which is often referred to as the critical field, $E_c$, tends to have a value which is a constant characteristic of the electrode metal employed, and typically has values lying in the range of between $10^7$ and $10^8$ v/cm. The magnitude of this electric field suggests that vacuum gaps are capable of having extremely high dielectric strength, such as 10 million volts across a one centimeter gap. In practice, however, this capability is seldom realized. One reason for this reduced capability is that the average electric field impressed across the gap between electrodes is almost always enhanced by a factor of between one and three by the shape of the electrodes, since electrodes used in practice seldom are designed to have perfectly flat facing surfaces. A much more important reason is that the microscopic features of the electrode surface, even those too small to see under optical microscopy, can enhance the electric field by a factor of 100 or more. Thus, while the critical field for typical electrode metals is as high as $10^8$ v/cm, the strength of a vacuum gap in practical devices is usually reduced to the order of $10^5$ v/cm. The field enhancement factor which accounts for this reduction in electric field strength is usually called $\beta$ and includes the combined effects of electrode design shape and microscopic surface structure. The field enhancement factor for a particular vacuum gap is influenced by such parameters as electrode material, surface hardness, cleanliness of the surface, and electrode conditioning. The relationship among the critical field, $E_c$, the breakdown voltage, $V_B$, the gap length, d, and the field enhancement factor, $\beta$, may be written as $$V_B=(E_c d)/\beta.$$

Since the critical field and the gap length for a particular vacuum device are constants, it can be seen from this equation that $\beta$ is small for gaps having a high breakdown voltage, while $\beta$ is generally large for gaps which break down at relatively low voltage. Thus, $\beta$ is an indicator of the general dielectric state of the vacuum gap.

Under certain conditions, the factor $\beta$ can be determined by measuring the emission current as described herein, that results from applying a voltage, at a level somewhat less than that required to produce breakdown, across the vacuum gap between the cathode and the anode. This emission current increases rapidly with increasing voltage, up to the breakdown voltage for the gap. As discussed at pages 24–35 of the book edited by J. M. Lafferty, *Vacuum Arc—Theory and Application*, John Wiley and Sons, New York, 1980, the dependence of this current upon voltage is described by the theory of Fowler and Nordheim as $$I=K_1V^2\,EXP\,(-K_2/V)$$

where $K_1$ and $K_2$ are approximately constant. From the theory discussed therein, it can be seen that if the logarithm of the quantity resulting from dividing the emission current by the square of the applied voltage is plotted as a function of the reciprocal of the applied voltage, the result is a straight line having a negative slope. The numerical value of this slope, disregarding the negative sign, can be directly related to $\beta$. Therefore, the emission current can be used to determine the value of $\beta$, which, in turn, can be used to assess the dielectric state of the vacuum gap.

However, field emission currents generally are small, typically being in the range of microamperes or smaller. For high voltage devices, leakage currents and corona currents can both easily exceed the emission currents to be measured. Also, unless the power supply used to apply voltage to the device is extremely well regulated and ripple free, displacement currents can be factors of ten larger than the emission current. Thus, measuring the emission current for a high voltage device can be very difficult. Furthermore, for a vacuum device, in which the cathode and the anode are enclosed in a vacuum chamber, measuring the emission current is very cumbersome because the gap between the cathode and the anode is not easily accessible. Finally, even if these difficulties can be overcome, there is a high risk of damaging sensitive current measuring equipment if breakdown should occur in the vacuum gap while the emission current is being measured. The present inventor has found that these difficulties can be avoided by using the radiation which is generated by electrons from the field emission current striking the anode as an analog for the emission current, rather than measuring the emission current directly.

One application in which it is useful to be able to determine the dielectric strength of the gap in a high voltage device is in the process of "aging" or "conditioning" the device. When a newly manufactured high voltage device is first subjected to voltage, the ability of that device to withstand high voltage is relatively poor. The dielectric properties of the device can be improved by a program of aging or conditioning which involves a series of steps of exposure to increasing levels and time periods of high voltage. Gap breakdown voltage capability can be improved by such a process by a factor of two or more. For this application, being able to determine the dielectric state of the gap allows optimization of the conditioning program, by facilitating the joint determination of which voltages and time periods are most effective and when to stop the process.

Accordingly, it is an object of the present invention to provide a method for indirectly determining the field emission current between the cathode and the anode of a high voltage vacuum device, a method which is not influenced by leakage, corona, or displacement effects.

It is also an object of the present invention to provide a method for determining the field emission current which does not require access to the vacuum gap.

It is a further object of the present invention to provide a method for determining the field enhancement factor, $\beta$, associated with the dielectric state of a high voltage vacuum device, without directly measuring the emission current between the cathode and the anode of such a device.

It is still another object of the present invention to provide a method for conditioning high voltage vacuum devices to improve the dielectric properties thereof, without breaking down the vacuum gap in such devices and without directly measuring the emission current between the cathode and the anode of such devices.

SUMMARY OF THE INVENTION

In accordance with one embodiment of the present invention, a method for determining the field emission current between the cathode and the anode of a high voltage vacuum device comprises applying a voltage, which is less than that required to produce breakdown, across the gap between the cathode and the anode of the device and measuring the radiation generated by electrons from field emission current striking the anode. The radiation measurement is correlated to the amount of field emission current by means of a predetermined relationship which is a function of the radiation measurement and the applied voltage.

In another embodiment, which is a method for assessing the dielectric state of a high voltage vacuum device by determining the field enhancement factor, $\beta$, the method described above further comprises varying the voltage applied across the gap to produce a range of radiation measurements. The factor $\beta$ is then determined from the slope of a graph in which the logarithm of the quantity resulting from dividing the emission current by the square of the applied voltage is plotted as a function of the reciprocal of the applied voltage. Alternatively, $\beta$ is determined from the slope of a plot in which the ordinate represents the radiation measurements for the different values of the applied voltage, and the abscissa represents the reciprocal of the applied voltage.

In yet another embodiment of the present invention, a method for conditioning high voltage vacuum devices includes one of the above two methods for determining $\beta$ and further comprises repeatedly subjecting the gap between the cathode and the anode of the device to a predetermined sequence of voltage levels and durations to increase the dielectric strength of the gap, until $\beta$ is below a predetermined value.

BRIEF DESCRIPTION OF THE DRAWINGS

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawings, in which:

DETAILED DESCRIPTION OF THE INVENTION

The instant inventor has found that an alternative to directly measuring the emission current between the cathode and the anode of a high voltage vacuum device is to measure the radiation generated by electrons from the field emission current striking the anode. In such devices, when a high voltage, at a level below that required to produce breakdown, is maintained across the vacuum gap, field emission current is extracted from the cathode surface. This current usually originates from microscopic imperfections in the cathode surface, where the electric field is especially intense. The emission has the form of one or more beams of electrons which cross the gap and impinge upon the opposing anode surface. Because the electrons from this current are accelerated to the full energy potential of the gap between the cathode and the anode, they produce radiation upon impact with the anode. The amount of radiation produced is nearly linearly related to the magnitude of the emission current, and is also dependent upon the voltage across the gap. The voltage dependence varies for different gap lengths, but the voltage dependence for a particular gap length can be determined empirically. Thus, the radiation magnitude can be used as an analog of the emission current. Using the radiation magnitude as an analog of the emission current, rather than directly measuring the emission current, provides a measurement method which, while being responsive to emission current within the vacuum enclosure, is not influenced by leakage, corona, or displacement effects, and which offers the additional advantage of not requiring access to the vacuum gap.

In accordance with the present invention, a method for using the radiation generated by electrons striking the anode of a high voltage vacuum device to determine the field emission current between the cathode and the anode thereof comprises applying a voltage across the gap between the cathode and the anode of the device. The applied voltage is less than that required to produce breakdown, and produces field emission current between the cathode and the anode. The radiation produced by electrons from the field emission current striking the anode is measured and correlated to the amount of field emission current by means of a predetermined relationship which is a function of the radiation measurement and the applied voltage. The amount of radiation is nearly linearly related to the magnitude of the emission current, and is related to the applied voltage by a relationship which can be determined empirically. It is not necessary to detect all of the radiation produced by the field emission current, in order to provide the radiation measurement of this invention. The present inventor has found that, at least for x-ray tubes, a radiation detector located in line with the normal x-ray exit window of the tube intercepts a useful part of the radiation and provides the required analog.

Figure 1:
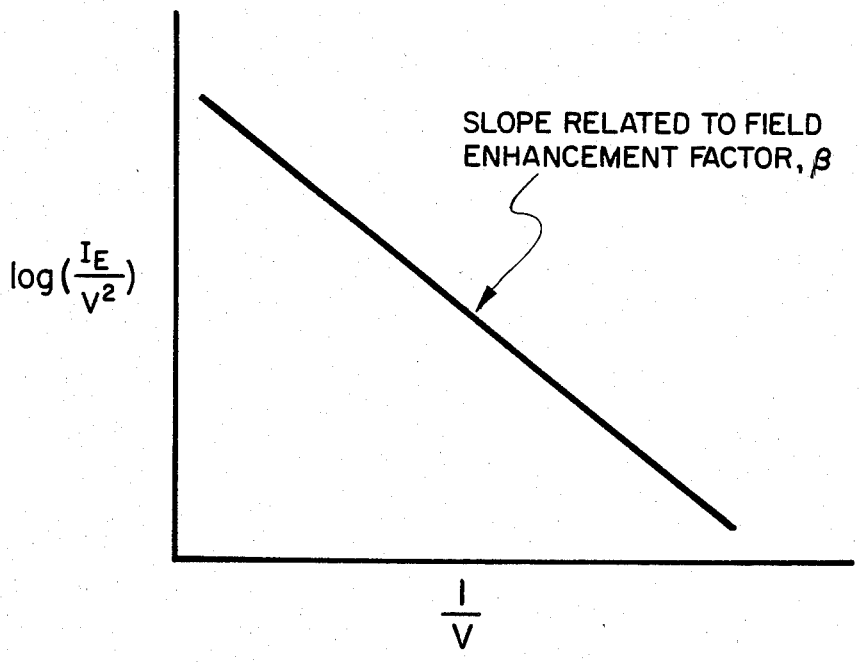
FIG. 1 is a graph of the logarithm of the quantity obtained by dividing the emission current by the square of the applied voltage, as a function of the reciprocal of the applied voltage.

The emission current determined by the method of this invention may be used as a means for assessing the dielectric state of the high voltage vacuum device involved. In accordance with another embodiment of the instant invention, the field enhancement factor, $\beta$, associated with the dielectric state of the device, is determined by applying a variable voltage across the gap between the cathode and the anode of the device, which voltage is less than that required to produce breakdown, so as to produce field emission current between the cathode and the anode. The radiation produced by electrons from the field emission current striking the anode is measured as a function of the applied voltage, for various values of the applied voltage. The radiation measurement for each value of the applied voltage is correlated to the amount of field emission current corresponding to that value of the applied voltage, by means of a predetermined relationship which is a function of the radiation measurement and the applied voltage. As noted herein, the amount of radiation is nearly linearly related to the emission current, and is related to the applied voltage by a relationship which can be determined for a particular gap length. The field enhancement factor, $\beta$, is determined from the slope of a plot in which the ordinate is the logarithm of the quantity resulting from dividing the emission current by the square of the applied voltage, and the abscissa is the reciprocal of the applied voltage. The type of graph resulting from plotting these functions is shown in FIG. 1. The plot is theoretically a straight line having a negative slope. The numerical value of this slope, disregarding the negative sign, is related to the field enhancement factor, $\beta$. The factor $\beta$ is, in turn, inversely proportional to the breakdown voltage of the gap between the cathode and the anode. Thus, $\beta$ can be used to assess the dielectric strength of the high voltage vacuum device.

Alternatively, the dielectric state of the device is determined from a plot of radiation level measurements, rather than emission current. In an alternative embodiment of the present invention, $\beta$ is determined from the slope of a plot in which the ordinate represents the radiation measurements for the different values of the applied voltage, and the abscissa represents the reciprocal of the applied voltage. Since the graph resulting from plotting the logarithm of the emission current as a function of reciprocal voltage is similar to the graph shown in FIG. 1 resulting from plotting the logarithm of the quantity obtained by dividing the emission current by the square of the voltage, as a function of reciprocal voltage, and since the radiation generated by the emission current is directly proportional to the amount of emission current, a plot of the radiation measurement as a function of reciprocal voltage is also a relatively straight line having a negative slope. Also, $\beta$ is related to the slope of the plot of radiation versus reciprocal voltage in a manner similar to that for the slope of the plot shown in FIG. 1.

Figure 2:
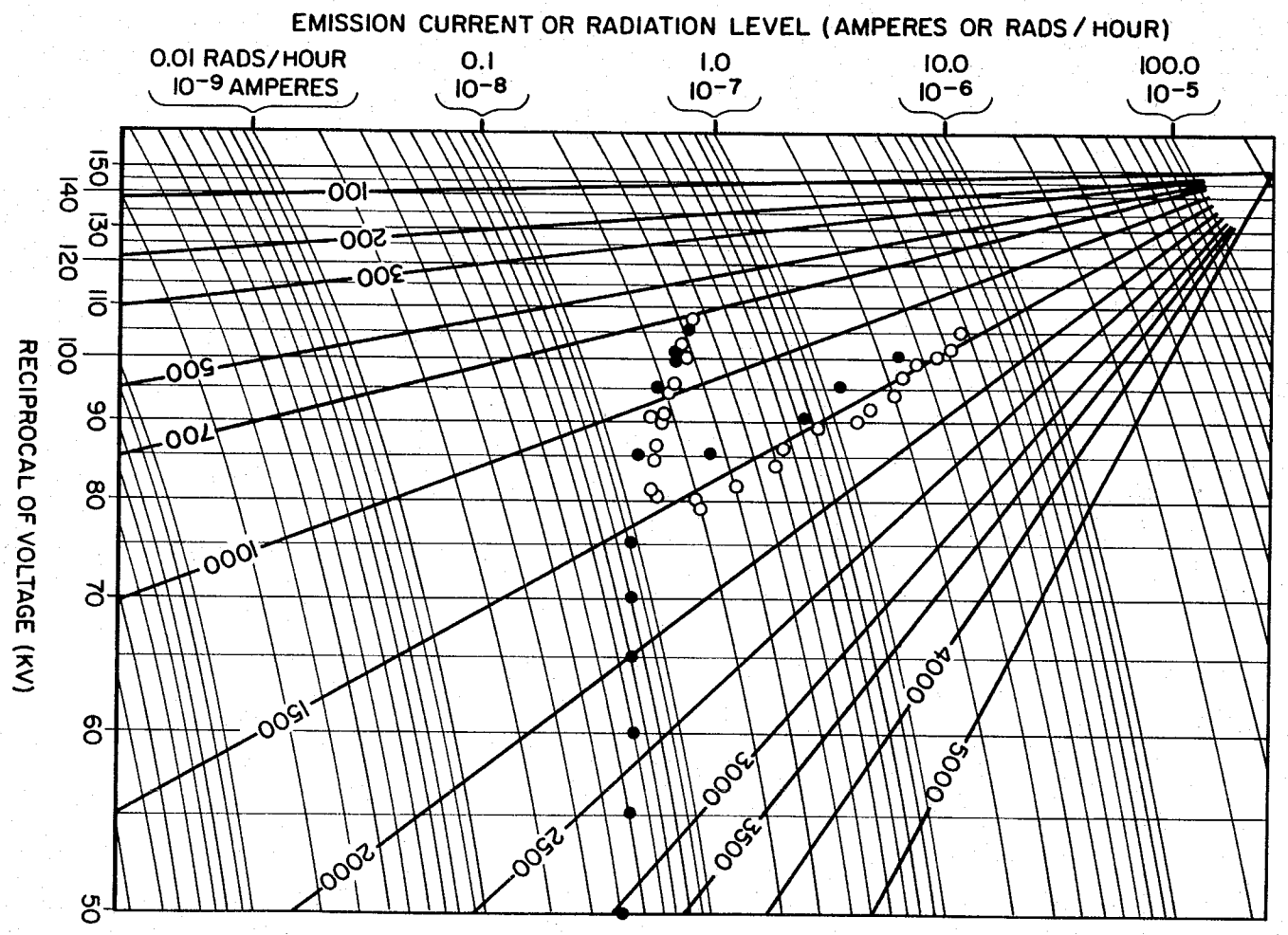
FIG. 2 is a graph of experimental data obtained from measuring both the current between the cathode and the anode of a high voltage x-ray tube and the x-ray radiation produced by the field emission current, as a function of applied voltage.

The present inventor has experimentally compared the measured current between the cathode and the anode of a high voltage x-ray tube with the x-ray radiation measured outside of the vacuum enclosure of the tube. The emission current measuring system consisted essentially of an oil tank in which the tube was totally immersed, a 150 kv high voltage power supply regulated to 0.1%, and a Keithley electrometer to monitor current. The power supply was connected so that the cathode voltage was nearly at electrical ground, and the anode voltage was at full positive potential. The emission current was monitored at the cathode through a network designed to protect the electrometer circuit from damage that might be caused by breakdown of the cathode-to-anode gap. X-ray radiation was monitored using two different survey meters located outside the oil tank, in a position opposite the normal x-ray exit window of the tube. The experimental data obtained for an x-ray tube manufactured by General Electric Company under the model designation MX-100 are shown in FIG. 2. The plotting paper used for FIG. 2 was generated from contours of constant value of log ($I_E/V^2$) versus 1/V, in the voltage range appropriate for the emission current measurements. It is often cumbersome and time-consuming to calculate $I_E/V^2$ and 1/V for the point pairs of emission current and corresponding applied voltage, and then measure the slope of the plotted data to determine the value of $\beta$. The plotting paper used for FIG. 2 allows direct plotting of voltage and emission current. The paper also has a series of lines drawn with a range of slopes having associated numerical values of $\beta$ ranging from 100 to 5000. The value of $\beta$ shown for each slope corresponds to a gap length of 0.9 inches, which is the appropriate gap length for the MX-100 tube. When emission current data for the MX-100 tube are plotted versus voltage using this paper, the value of $\beta$ can be found by determining which of the lines has a slope that matches the slope of the plotted data. The lower of the two sets of data points shown in FIG. 2 represents the plot of the data obtained for measured emission current as a function of voltage. The filled circles represent the data obtained while the applied voltage was being increased, and the unfilled circles represent the data obtained while the voltage was being decreased. It can be seen from FIG. 2 that the plotted data do not form a straight line of negative slope, as is the theoretical result for pure field emission current. Moreover, the curvature of the plotted data, from a negative slope to a slope tending to become positive at low voltage, is indicative of a significant component of displacement current or leakage current in the current measurements. The upper of the two sets of plotted data shown in FIG. 2 represents the radiation levels measured at the same time as the emission current measurements were obtained. Again, the data shown as filled circles were obtained while the voltage was being increased, and the data shown as unfilled circles were obtained while the voltage was being decreased. It can be seen that the plotted data for the radiation level measurements form a relatively straight line and have a significantly more negative slope than the plot for emission current. As shown in FIG. 2, the slope of the plotted data corresponds to a $\beta$ value of about 1500. Since the critical field, $E_c$, for a steel surface in vacuum is expected to be about $8\times10^7$ v/cm, the breakdown voltage, $V_B$, predicted by this radiation level data is $V_B=(E_c d)/\beta=(8\times10^7\ v/cm)(2.29\ cm)/1500=122$ kv.

Thus, the breakdown voltage predicted by the radiation level measurements has a value which is reasonable for the tube under study.

The present inventor has also found that the methods described hereinabove for assessing the dielectric state of a high voltage vacuum device can be employed to provide a method for "conditioning" or "aging" such a device, to improve the dielectric properties thereof. In accordance with another embodiment of the present invention, a method for conditioning a high voltage vacuum device includes one of the methods of this invention for assessing the dielectric state of the device by determining the associated field enhancement factor, $\beta$, and further comprises repeatedly subjecting the gap between the cathode and the anode of the device to a predetermined sequence of voltage levels and durations. The predetermined program of exposure to high voltage is chosen so as to increase the dielectric strength of the gap, and the program's sequence of voltage levels and durations is repeated until the value of $\beta$ associated with the dielectric state of the gap is below a predetermined level. This method of conditioning high voltage vacuum devices allows optimization of the conditioning program, by facilitating the joint determination of which voltages and time periods are most effective and when the program should be stopped. This method also may be employed to control an automated aging or conditioning process, which could eliminate the need for, and the variableness associated with, human operator judgment.

In accordance with the methods of this invention, the present investigator has studied the effects of an aging program on two MX-100 x-ray tubes. Values of $\beta$ were determined by using radiation level measurements for each tube, before beginning the conditioning program and at various intervals in the program. Prior to any aging, the $\beta$ values for the two tubes were 2,500 and 5,000, respectively. These values of $\beta$ correspond to breakdown voltages of 74 kv and 37 kv, respectively, which are not unreasonable for new, unconditioned vacuum gaps. During the conditioning program, a relatively smooth decline in the value of $\beta$ was observed for both tubes, to a common value of 1,700 for both tubes. This value of $\beta$ corresponds to a breakdown voltage of 107 kv, which is also a reasonable value for the type of vacuum device being studied. Thus, the value of $\beta$ associated with the dielectric state of the device at various intervals in the conditioning program, determined in accordance with the methods of this invention by measuring the radiation levels, varied in a systematic way as aging progressed and has magnitudes which are within the expected range.

From the foregoing, it can be seen that measuring the radiation generated by electrons from field emission current striking the anode of a high voltage vacuum device provides an analog for the emission current. The present invention provides a method for indirectly determining the field emission current between the cathode and the anode of such a device, which method is not influenced by leakage, corona, or displacement effects and which does not require access to the vacuum gap. The instant invention also provides a method for determining the field enhancement factor, $\beta$, associated with the dielectric state of a high voltage vacuum device, without directly measuring the emission current, and a method for conditioning such devices to improve the dielectric properties thereof, without breaking down the vacuum gap between the cathode and the anode of the device.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A method for determining the field emission current between the cathode and the anode of a high voltage vacuum device, of the type having a vacuum chamber housing enclosing the cathode and the anode, comprising:

applying a voltage across the gap between the cathode and the anode of said high voltage vacuum device, with said voltage being less than that required to produce breakdown, so as to produce field emission current between said cathode and said anode;

measuring the radiation produced by electrons from said field emission current striking said anode; and correlating said radiation measurement to the amount of field emission current between said cathode and said anode, by means of a predetermined relationship which is a function of said radiation measurement and said applied voltage.

2. The method of claim 1 wherein said measuring step comprises measuring the x-ray radiation produced by electrons from said field emission current striking said anode.

3. The method of claim 2 wherein said measuring step further comprises measuring said x-ray radiation by means of an x-ray detector placed outside of said vacuum chamber housing of said high voltage vacuum device.

4. A method for assessing the dielectric state of a high voltage vacuum device of the type having a vacuum chamber housing enclosing a cathode and an anode, by using the radiation generated by field emission currents to determine the field enhancement factor, $\beta$, associated with said dielectric state, which factor is inversely proportional to the dielectric strength of said vacuum device, comprising:

applying a variable voltage across the gap between said cathode and said anode of said high voltage vacuum device, with said voltage being less than that required to produce breakdown, so as to produce field emission current between said cathode and said anode;

measuring the radiation produced by electrons from said field emission current striking said anode, while varying said variable voltage;

correlating said radiation measurement for each value of said variable voltage to the amount of field emission current between said cathode and said anode corresponding to each value of said variable voltage, by means of a predetermined relationship which is a function of said radiation measurement and said applied voltage; and determining said field enhancement factor, $\beta$, from the slope of a plot in which the ordinate is the logarithm of the quantity resulting from dividing said emission current by the square of said applied voltage, and the abscissa is the reciprocal of said applied voltage.

5. The method of claim 4 wherein said measuring step comprises measuring the x-ray radiation produced by electrons from said field emission current striking said anode.

6. The method of claim 5 wherein said measuring step further comprises measuring said x-ray radiation by means of an x-ray detector placed outside of said vacuum chamber housing of said high voltage vacuum device.

7. A method of assessing the dielectric state of a high voltage vacuum device of the type having a vacuum chamber housing enclosing a cathode and an anode, by using the radiation generated by field emission currents to determine the field enhancement factor, $\beta$, associated with said dielectric state, which factor is inversely proportional to the dielectric strength of said vacuum device, comprising:

applying a varible voltage across the gap between said cathode and said anode of said high voltage vacuum device, with said voltage being less than that required to produce breakdown, so as to produce field emission current between said cathode and said anode;

measuring the radiation produced by electrons from said field emission current striking said anode, while varying said variable voltage; and determining said field enhancement factor, $\beta$, from the slope of a plot in which the ordinate represents said radiation measurements, for the different values of said applied voltage, and the abscissa represents the reciprocal of said applied voltage.

8. The method of claim 7 wherein said measuring step comprises measuring the x-ray radiation produced by electrons from said field emission current striking said anode.

9. The method of claim 8 wherein said measuring step further comprises measuring said x-ray radiation by means of an x-ray detector placed outside of said vacuum chamber housing of said high voltage vacuum device.

10. A method for conditioning high voltage vacuum devices, to improve the dielectric properties thereof, including the method of claim 4 for assessing the dielectric state of said high voltage vacuum device, and further comprising repeatedly subjecting the gap between the cathode and the anode of said vacuum device to a predetermined sequence of voltage levels and durations, so as to increase the dielectric strength of said gap, until the field enhancement factor, $\beta$, associated with the dielectric state of said device is below a predetermined value.

11. A method for conditioning high voltage vacuum devices, to improve the dielectric properties thereof, including the method of claim 7 for assessing the dielectric state of said high voltage vacuum device, and further comprising repeatedly subjecting the gap between the cathode and the anode of said vacuum device to a predetermined sequence of voltage levels and durations, so as to increase the dielectric strength of said gap, until the field enhancement factor, $\beta$, associated with the dielectric state of said device is below a predetermined value.

* * * * *